US005865314A

United States Patent [19]

Jacober

[11] Patent Number: 5,865,314

[45] Date of Patent: Feb. 2, 1999

[54] CASE FOR INJECTABLE MEDICATION WITH COOLING COMPARTMENT

[75] Inventor: Jeffrey M. Jacober, Providence, R.I.

[73] Assignee: MEDport, Inc., Providence, R.I.

[21] Appl. No.: 667,427

[22] Filed: Jun. 21, 1996

[51] Int. Cl.[6] ..... F25D 3/08; A45C 11/20; B65D 69/00

[52] U.S. Cl. ..... 206/570; 62/457.1; 62/457.2; 150/117; 206/570

[58] Field of Search ..... 206/570, 571; 150/112, 113, 116, 117; 190/901; 62/457.2, 457.1, 457.9, 372

[56] References Cited

U.S. PATENT DOCUMENTS

| | | | |
|---|---|---|---|
| D. 284,715 | 7/1986 | Jacober et al. . | |
| D. 299,406 | 1/1989 | Jacober . | |
| D. 322,358 | 12/1991 | Jacober et al. . | |
| 1,790,497 | 1/1931 | Brady | 150/117 X |
| 2,022,162 | 11/1935 | Speik et al. | 150/117 X |
| 2,554,215 | 5/1951 | Schell et al. | 190/901 X |
| 2,623,566 | 12/1952 | Kibler | 190/901 X |
| 2,648,366 | 8/1953 | Higbee et al. | 206/570 |
| 2,804,969 | 9/1957 | Barnett | 206/570 X |
| 3,743,130 | 7/1973 | Jorgensen | 62/457.1 X |
| 4,024,731 | 5/1977 | Branscum . | |
| 4,050,264 | 9/1977 | Tanaka . | |
| 4,065,336 | 12/1977 | Conklin . | |
| 4,213,310 | 7/1980 | Buss . | |
| 4,319,629 | 3/1982 | Hotta . | |
| 4,336,883 | 6/1982 | Krug et al. . | |
| 4,343,158 | 8/1982 | Campbell | 62/457.1 X |
| 4,351,385 | 9/1982 | Amey . | |
| 4,429,793 | 2/1984 | Ehmann | 206/570 |
| 4,461,332 | 7/1984 | Parkhurst | 150/112 |
| 4,499,998 | 2/1985 | Carlson . | |
| 4,706,856 | 11/1987 | Jacober . | |
| 4,767,039 | 8/1988 | Jacober . | |
| 4,917,238 | 4/1990 | Schomaker | 206/570 X |
| 4,940,173 | 7/1990 | Jacober . | |
| 4,984,662 | 1/1991 | Jacober . | |
| 5,007,250 | 4/1991 | Musrelak | 62/457.1 X |
| 5,040,678 | 8/1991 | Lenmark, Sr. et al. . | |
| 5,090,526 | 2/1992 | Jacober . | |
| 5,109,961 | 5/1992 | Bergman | 150/117 X |
| 5,181,612 | 1/1993 | Liu . | |
| 5,361,603 | 11/1994 | Merritt-Munson | 62/457.2 |
| 5,400,610 | 3/1995 | Macedo . | |
| 5,533,361 | 7/1996 | Halpern | 62/457.2 |

*Primary Examiner*—Bryon P. Gehman
*Attorney, Agent, or Firm*—Lockwood, Alex, FitzGibbon & Cummings

[57] ABSTRACT

An injectable medication carrying case is disclosed which includes a top panel, a bottom panel opposing the top panel, two opposing side panels, two opposing end panels, and a thermally-insulating divider panel. The top panel, bottom panel, side panels and end panels can be joined together in standard fashion at respective edges of the carrying case. The divider panel partitions the body portion of the case into two distinct thermally-insulated sides. In this arrangement, the patient is able to selectively store his injectable medication supplies in a unitary carrying case, as opposed to a plurality of carrying cases.

44 Claims, 7 Drawing Sheets

9
241
228a
220
228b
320
235
236
317
243
234
318
237
322a
322b
9

228a
248
348
228b
262
264
222
344
224
330
332
324
322a
240
346
226

CASE FOR INJECTABLE MEDICATION WITH COOLING COMPARTMENT

BACKGROUND OF THE INVENTION

The present invention is generally directed to soft-walled cases for carrying injectable medication. More particularly, the present invention is directed to a soft-walled case having a thermally-insulating divider panel that partitions the body portion of the case into a room temperature side and a cool side. The thermally-insulating divider panel allows the patient to selectively separate and effectively display injectable medication supplies and the like within the body portion of the case.

Soft-walled cases for storing a variety of items are well known. Prior injectable medication storing cases include a body portion defining an enclosure for storing the medication. While in their closed configuration, these prior injectable medication cases generally assume a three-dimensional rectilinear shape, much like a standard rectangular box. One panel of these prior injectable medication carrying cases, typically the top panel, is opened to expose the contents stored within the enclosure of the case. Typically, injectable medication is stored within that enclosure. After opening the case, the injectable medication is removed for administration to the patient.

Although these prior injectable medication carrying cases have proven adequate in a few limited applications, they do not measure up to the benefits achieved through the use of the present invention. To be administered properly, injectable medication often needs to be kept at a temperature level cooler than standard room temperature. Conversely, it is important to keep injection needles, electronic meters, and the like at standard room temperature. Under the prior art, the patient often has found it necessary to carry his or her injectable medication and other supplies in two different cases, storing each medical supply independently at its requisite temperature level.

As will be apparent from the description below, the carrying case of the present invention includes a cool side and a room temperature side, thereby allowing the patient to selectively store injectable medication supplies in a unitary carrying case, as opposed to a plurality of carrying cases. In particular, the carrying case includes a thermally-insulating divider panel which partitions the case into two temperature level-distinguishing sides.

In addition to this feature, the carrying case of the present invention permits convenient and effective display of the medical supplies of the patient while in one of its open configurations, thereby making the supplies readily accessible to the patient. The present invention utilizes several of its unique structural and functional features, particularly its thermally-insulating divider panel, to provide for a functional result, namely the effective display of the medical supplies of the patient.

Accordingly, it is a general object of the present invention to provide a new and improved injectable medication carrying case.

It is a more specific object of the present invention to provide an injectable medication carrying case which allows the patient to temporarily store injectable medication supplies in a unitary case.

It is a still more specific object of the present invention to provide an injectable medication carrying case which has both a cool side and a room temperature side.

Yet another object of the present invention is to provide an injectable medication carrying case which, through its structural and functional features, displays the medical supplies of the patient in a convenient and effective manner, particularly when the case is in one of its open configurations.

SUMMARY OF THE INVENTION

A case for carrying injectable medication supplies according to the present invention includes a top panel, a bottom panel opposing the top panel, a first side panel, a second side panel opposing the first side panel, and a thermally-insulating divider panel. The top panel is capable of being joined with the first and second side panels and with the first and second end panels, respectively, to form a first plurality of edges of the case. The bottom panel is also capable of being joined with the first and second side panels and with the first and second end panels, respectively, to form a second plurality of edges of the case. The divider panel partitions the body portion of the case into two distinct compartments which are thermally insulated from one another.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DETAILED DESCRIPTION OF THE PREFERRED EMBODIMENTS

Figure 1:
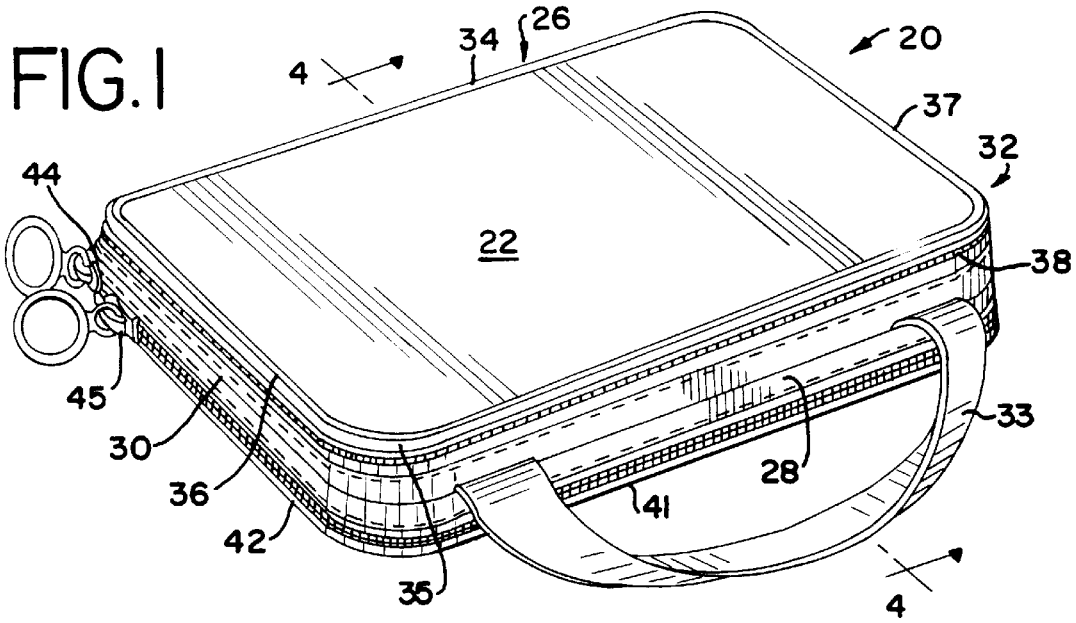
FIG. 1 is a perspective view of an injectable medication carrying case constructed in accordance with the invention and shown in its closed configuration.

Referring generally to FIGS. 1–5, and first more particularly to FIG. 1, a new and improved injectable medication carrying case 20 is shown. The carrying case includes a top panel 22, a bottom panel 24 opposite the top panel, two opposing side panels 26 and 28, two opposing end panels 30 and 32, and a carrying handle 33. Top panel 22 and side panel 26 are preferably joined at edge 34 of carrying case 20. In the embodiment shown in FIGS. 1–5, top panel 22 is selectively and releasably secured with side panel 28 and with end panels 30 and 32 at edges 35, 36 and 37 of carrying case 20. A top releasable attachment assembly is preferably shown as a double pull zipper 38 having pulls 39*a* and 39*b* (see FIG. 2). The top releasable attachment assembly provides the selective and releasable attachment of top panel 22 with panels 28, 30 and 32. Double pull zipper 38 may be conventional in design and operation as is well known in the art. The top releasable attachment assembly, shown as double pull zipper 38, preferably lies along edges 35, 36 and 37 while case 20 is in its closed configuration. In this arrangement, the case may readily lie flat against its top panel while in its fully open configuration (see FIG. 5).

It will be appreciated that edge 34 includes a hinge feature which generally corresponds to the portion of such edge 34 which is permanently secured to panel 22. The hinge portion preferably is shorter than the full length of the edge 34 to thereby minimize any interference between the releasable attachment assembly and the operation of the hinge portion. This facilitates the feature by which the panel of the case remains open when once opened in its entirety.

Bottom panel 24 and side panel 26 are preferably joined at edge 40 of carrying case 20. In the embodiment shown in FIGS. 1–5, bottom panel 24 is selectively and releasably secured with side panel 28 and with end panels and 32 at edges 41, 42 and 43 of carrying case 20. A bottom releasable attachment assembly is preferably shown as a double pull zipper 44 having pulls 45*a* and 45*b*. The bottom releasable attachment assembly provides the selective and releasable attachment of bottom panel 24 with panels 28, 30 and 32. Double pull zipper 44 may be conventional in design and operation as is well known in the art. The bottom releasable attachment assembly, shown as double pull zipper 44, preferably lies along edges 41, 42 and 43 while case 20 is in its closed configuration. In this arrangement, the case may remain open when its bottom panel 24 is detached and spaced apart from panels 28, 30 and 32.

Figure 2:
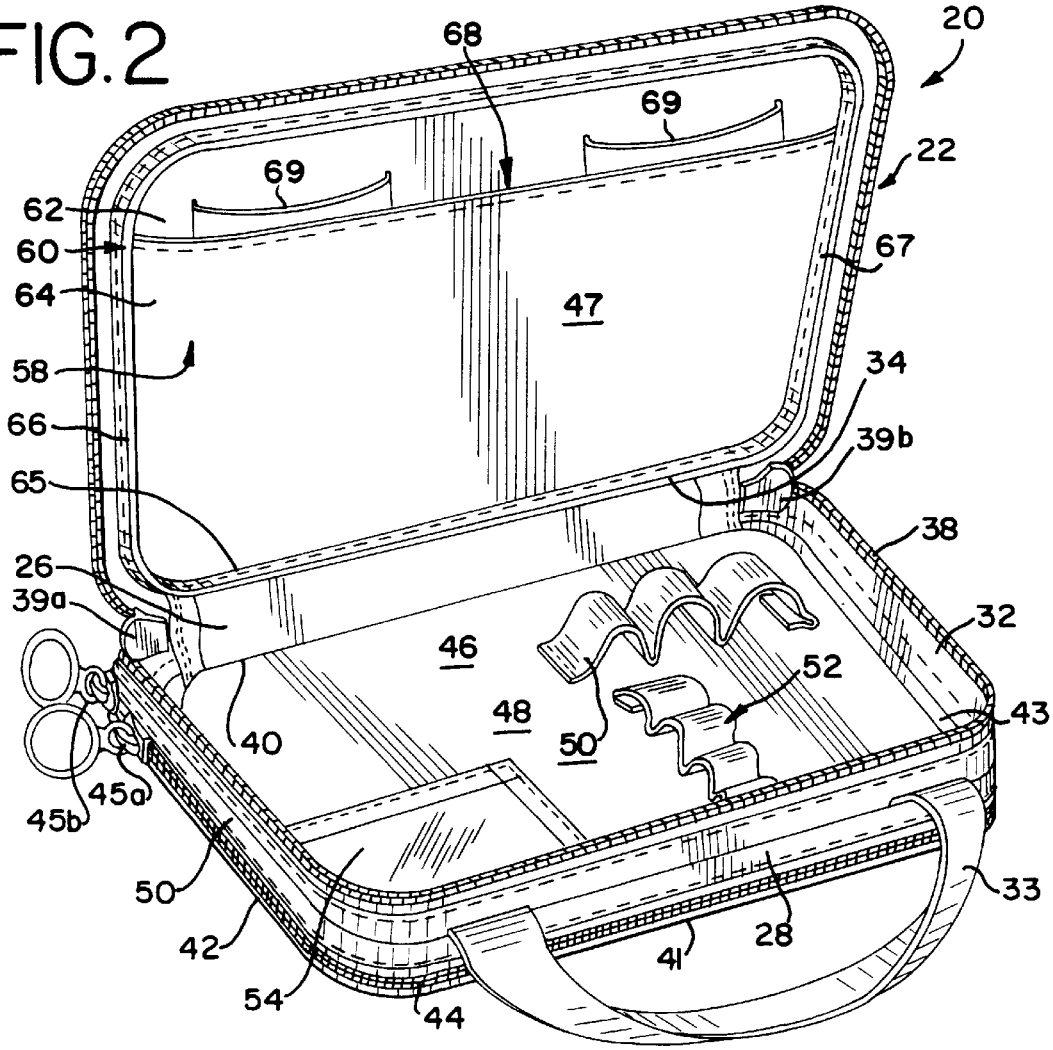
FIG. 2 is a perspective view of the injectable medication carrying case of FIG. 1 shown in one of its open configurations, displaying the interior portion of the cool compartment of that carrying case.

Referring now particularly to FIG. 2, carrying case 20 is shown in one of its open configurations wherein the medical supplies temporarily stored within the cool compartment 46 of the case are readily visible and accessible to the patient. To open the carrying case so that the supplies stored within cool compartment 46 are accessible to the patient, it is necessary to merely unzip (or otherwise manipulate) the attachment assembly, shown as double pull zipper 38, so that top panel 22 is released from side panel 28 and from end panels 30 and 32. Top panel 22 is then turned over at edge 34 to expose its underside 47 and the corresponding contents stored within the cool compartment 46 of the case to the patient.

A divider panel generally designated as reference numeral 48 is made visible to the patient when the carrying case 20 is in its open configuration shown in FIG. 2. The divider panel essentially serves as a back panel for cool compartment 46 when the case is in its closed configuration. Accordingly, cool compartment 46 is defined by the bounded volume of top panel 22 and divider panel 48 (comprising the first dimension of the bounded volume), side panel 26 and side panel 28 (comprising the second dimension of the bounded volume), and end panel 30 and end panel 32 (comprising the third dimension of the bounded volume).

Divider panel 48 is preferably comprised of layers of thermally-insulating material as is well known in the art. This construction ensures that the medical supplies stored within cool compartment 46 are thermally insulated from the supplies stored within the room temperature side of the case, described below.

The surface of divider panel 48 shown in FIG. 2 preferably includes two elastic strips 50 and 52 and a plastic strip 54. Elastic strips 50 and 52 are each sewn to the surface of divider panel 48 at predetermined locations, forming retaining chambers for selectively storing supplies within the cool compartment 46 of the case. For instance, the elastic strip 50 may retain insulin containers which are desirably held at a temperature level cooler than standard room temperature.

The plastic strip is likewise sewn or otherwise secured to the surface of divider panel 48, forming a retaining pouch for other medical supplies stored within cool compartment 46 of carrying case 20. For example, the patient may place syringes within the retaining pouch formed by plastic strip 54. In a preferred manner, the patient may further secure the syringes stored within the pouch formed by plastic strip 54 by holding them within the retaining chambers formed by elastic strip 52 such that the syringes each span and are supported by both elastic strip 52 and plastic strip 54. It is for this reason that elastic strip 52 is preferably in a generally perpendicular relationship with elastic strip 50.

When carrying case 20 is in its open configuration depicted in FIG. 2, the underside 47 of top panel 22 is also readily visible to the patient. A refreezable ice pack storage compartment 58 is attached to underside 47. Compartment 58 which is illustrated comprises a facing strip 60, a back liner 62 and a pouch layer 64. Facing strip 60, which is preferably made from a polymer sheeting, extends substantially along the outer perimeter of underside 47 of top panel 22. Back liner 62 is sewn to facing strip 60 and is contained within the area outlined by the facing strip. Pouch layer 64 is sewn or otherwise secured along the edge 65 of facing strip 60, edge 65 being adjacent to edge 34 of carrying case 20. Furthermore, pouch layer 64 is sewn or otherwise secured along substantial portions of opposing edges 66 and 67 of the rectilinear-shaped facing strip 60, leaving a pocket 68 for housing cooling elements 69 such as the refreezable ice packs which are generally known in the art. The cooling elements selectively stored within compartment 58 maintain the temperature within cool compartment 46 of the carrying case at a level which is lower than ordinary room temperature. It is to be appreciated that divider panel 48 insulates cool compartment 46 from the room temperature compartment of the case, described below. Therefore, injectable medication supplies which are meant to be stored at a temperature level cooler than room temperature may be placed within cool compartment 46. Correspondingly, those supplies which are meant to be stored at room temperature may be placed within the room temperature compartment of the case.

Figure 3:
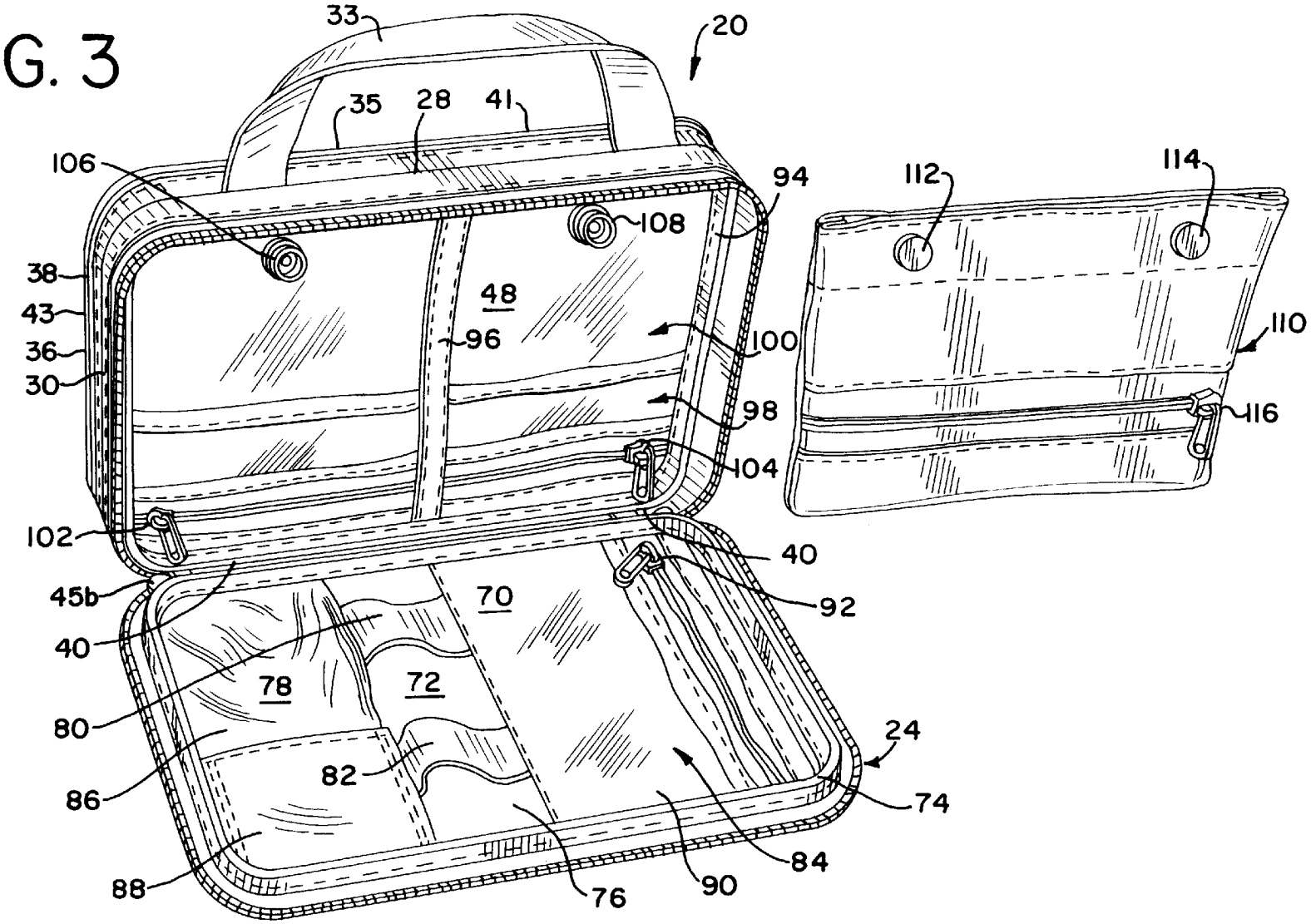
FIG. 3 is a perspective view of the injectable medication carrying case of FIGS. 1 and 2, including its removable waste pouch, shown in another of its open configurations, displaying the interior portion of the room temperature compartment of that carrying case.
Figure 4:
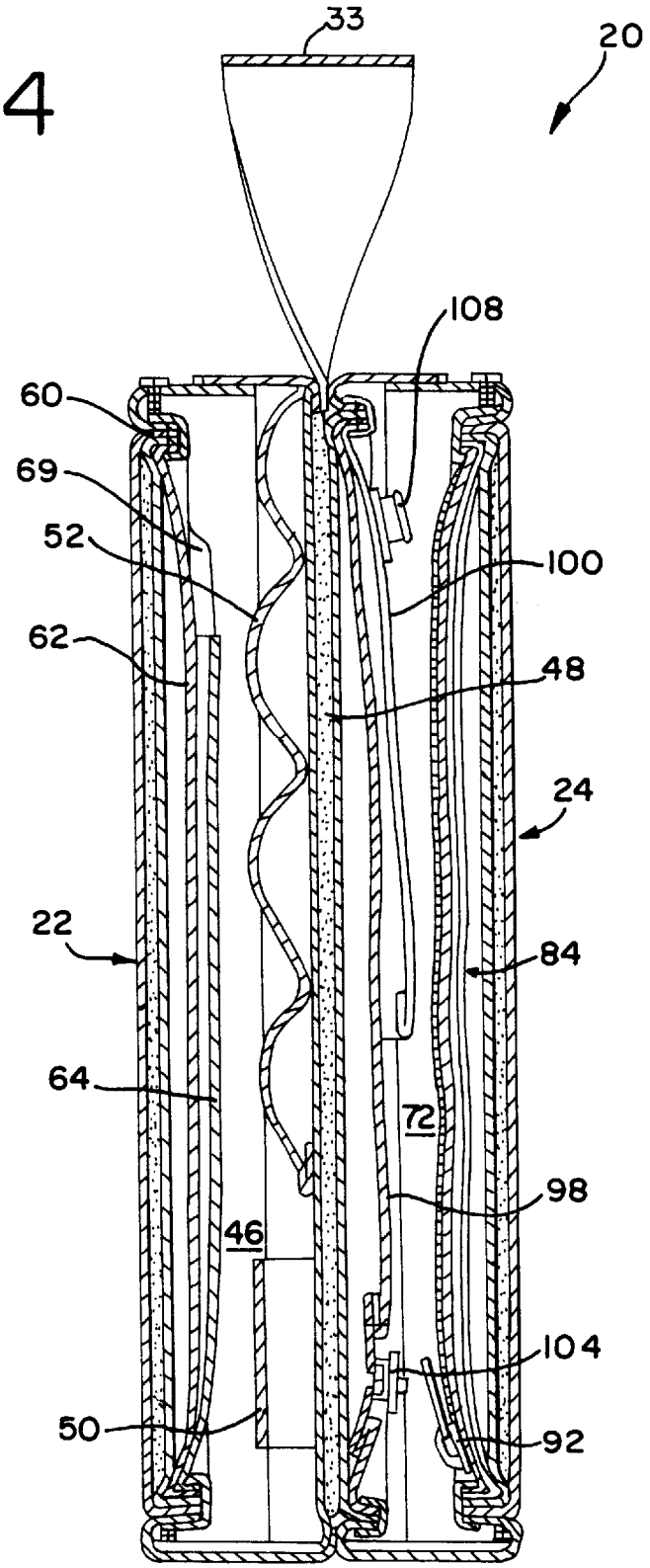
FIG. 4 is a cross-sectional view of the injectable medication carrying case taken along line 4—4 of FIG. 1.
Figure 5:
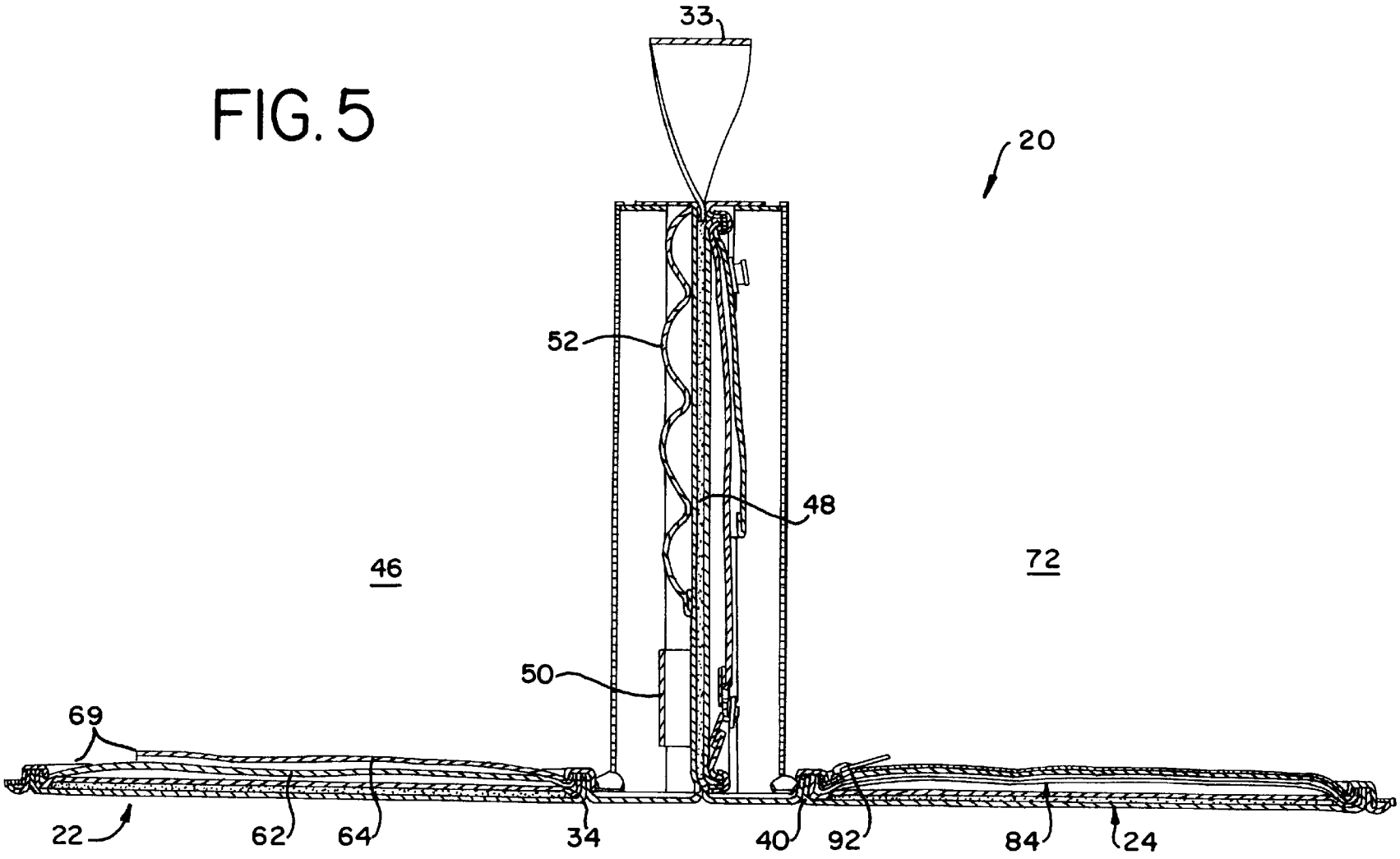
FIG. 5 is a cross-sectional view generally the same as that shown in FIG. 4 but with the top and bottom panels of the injectable medication case partially detached and spaced apart from the thermally-insulating divider panel.

Referring now particularly to FIG. 3, carrying case 20 is shown in another one of its open configurations wherein the injectable medication supplies temporarily stored within the room temperature compartment of the carrying case are readily visible and accessible to the patient. To partially open the carrying case so that the supplies selectively stored within room temperature compartment 72 of the case are displayed to the patient, it is necessary to merely unzip (or otherwise manipulate) the attachment assembly, shown as double pull zipper 44, so that bottom panel 24 is released from side panel 28 and from end panels 30 and 32. Bottom panel 24 is then turned over at edge 40 to expose its underside 70 and the contents stored within room temperature side 72 to the patient.

When the case is in its open configuration shown in FIG. 3, divider panel 48 is also readily visible by the patient. However, the surface of the divider panel shown in this open configuration is opposite of the surface visible by the patient when carrying case 20 is in its open configuration shown in FIG. 2. As described above, divider panel 48 thermally insulates the injectable medication supplies selectively stored within room temperature compartment 72 from those supplies stored within cool compartment 46. The room temperature compartment 72 is defined by the bounded volume of bottom panel 24 and divider panel 48 (comprising a first dimension of the bounded volume), side panel 26 and side panel 28 (comprising a second dimension of the bounded volume), and end panel 30 and end panel 32 (comprising a third dimension of the bounded volume).

A variety of storage compartments are preferably placed along underside 70 of bottom panel 24. In the embodiment shown in FIG. 3, the underside 70 comprises a facing strip 74, a liner 76, a pouch 78, elastic strips 80 and 82, and a plastic retaining compartment 84. Facing strip 74, which is preferably made from a polymer sheeting, extends substantially along the outer perimeter of underside 70 of bottom panel 24. Liner 76 is sewn or otherwise secured to facing strip 74 and is contained within the area outlined by the facing strip. Pouch 78 is comprised of a bottom liner 86 and a top liner 88. The bottom liner is sewn or otherwise secured to portions of facing strip 74 and liner 76. One edge of bottom liner 86 is free from attachment, however, to define a mouth portion (not shown) for pouch 78. As a result, pouch 78 is able to retain selected injectable medication supplies of the patient. Once these supplies are stored within the pouch, top liner 88 is secured with bottom liner 86 to help retain the supplies. In its preferred form, a hook-and-loop fastener (not shown), such as a VELCRO brand fastener, secures top liner 88 with bottom liner 86.

Elastic strips 80 and 82 are sewn or otherwise secured to liner 76 between pouch 78 and the plastic retaining compartment 84, described below. The elastic strips allow the patient to temporarily store medical supplies such as plastic containers of prescription tablets and the like.

The plastic retaining compartment 84 includes a strip of plastic material 90 which is sewn or otherwise secured to liner 76 and portions of facing strip 74. A releasable attachment assembly, such as the zipper 92 shown in FIG. 3, provides a mouth opening for compartment 84. Compartment 84 preferably stores needle syringes and the like.

The surface of the illustrated divider panel 48 within room temperature compartment 72 of the case may likewise house a variety of compartments for selectively storing injectable medication supplies of the patient. The surface of divider panel 48 includes a facing strip 94, a separation strip 96, a plastic liner 98, a plastic strip 100, two releasable attachment assemblies (shown as zippers 102 and 104), and two male-type snap fittings 106 and 108.

As shown, facing strip 94, which is preferably made from a polymer sheeting, extends substantially along the outer perimeter of the surface of divider panel 48 shown in FIG. 3. Plastic liner 96 is attached along the edges of facing strip 94 and is contained within the area outlined by the facing strip. Separation strip 98 is secured to opposing edges of facing strip 94 and to plastic liner 98, thereby forming two separate storage compartments bounded by plastic liner 96 and the surface of divider panel 48 contained within room temperature compartment 72. Zippers 102 and 104 provide openings for these respective compartments and facilitate entry and exit of the injectable medication supplies selectively stored within those compartments.

Plastic strip 100, which preferably has a smaller area than plastic liner 96, provides additional compartments for storage of medical supplies. Male-type snap fittings 106 and 108 are attached to plastic strip 100 to allow a removable waste pouch 110 to snappingly engage therewith. In particular, removable waste pouch 110 includes complementary female-type snap fittings 112 and 114 which allow the waste pouch to snappingly and removably engage with the storage compartments located on divider panel 48. Alternative easily releasable attachment arrangements can be used instead, such as hook-and-loop fasteners (preferably VELCRO brand fasteners), zippers and the like.

Removable waste pouch 110 provides a safe alternative for the medical wastes of the patient until they can be properly disposed. The patient preferably disposes of used syringe needles within the waste pouch until such needles can be otherwise properly disposed. A releasable attachment assembly, such as the zipper 116 shown in the preferred embodiment, facilitates access to and from the removable waste pouch.

Figure 6:
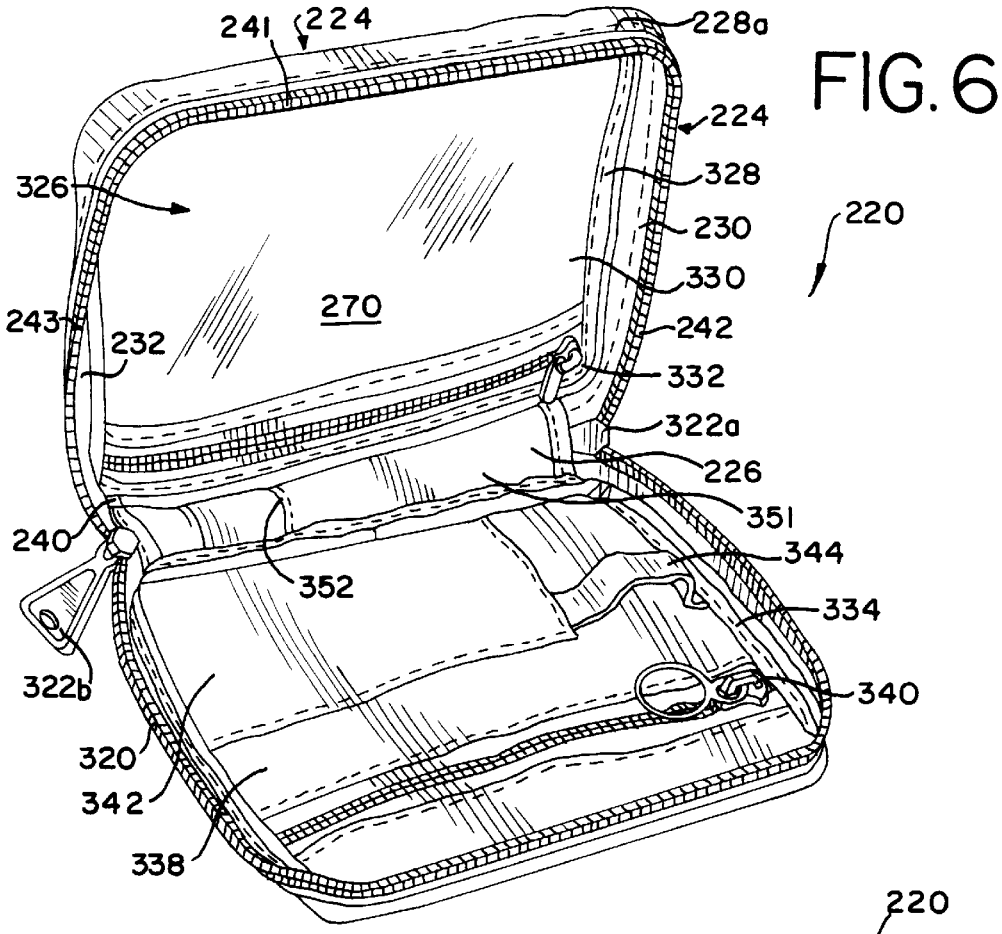
FIG. 6 is a perspective view of an alternative embodiment of an injectable medication carrying case constructed in accordance with the invention and shown in one of its open configurations, displaying the interior portion of the room temperature compartment of that carrying case.
Figure 7:
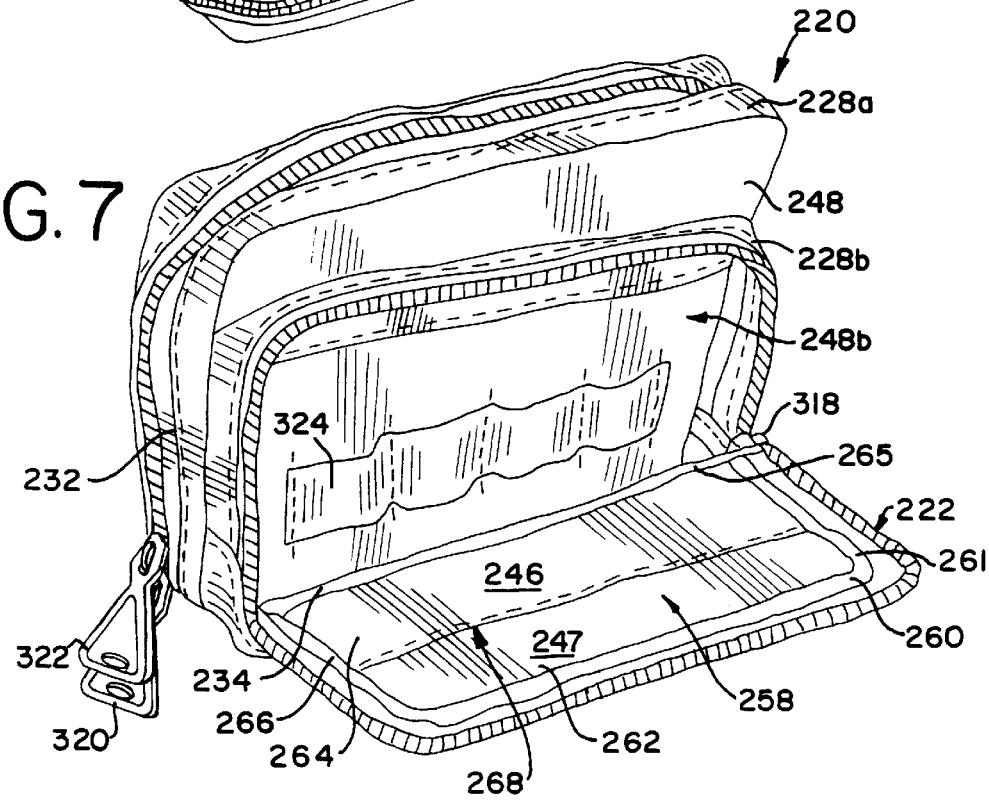
FIG. 7 is a perspective view of the injectable medication carrying case of FIG. 6 shown in another of its open configurations, displaying the interior portion of the cool compartment of that carrying case.
Figure 8:
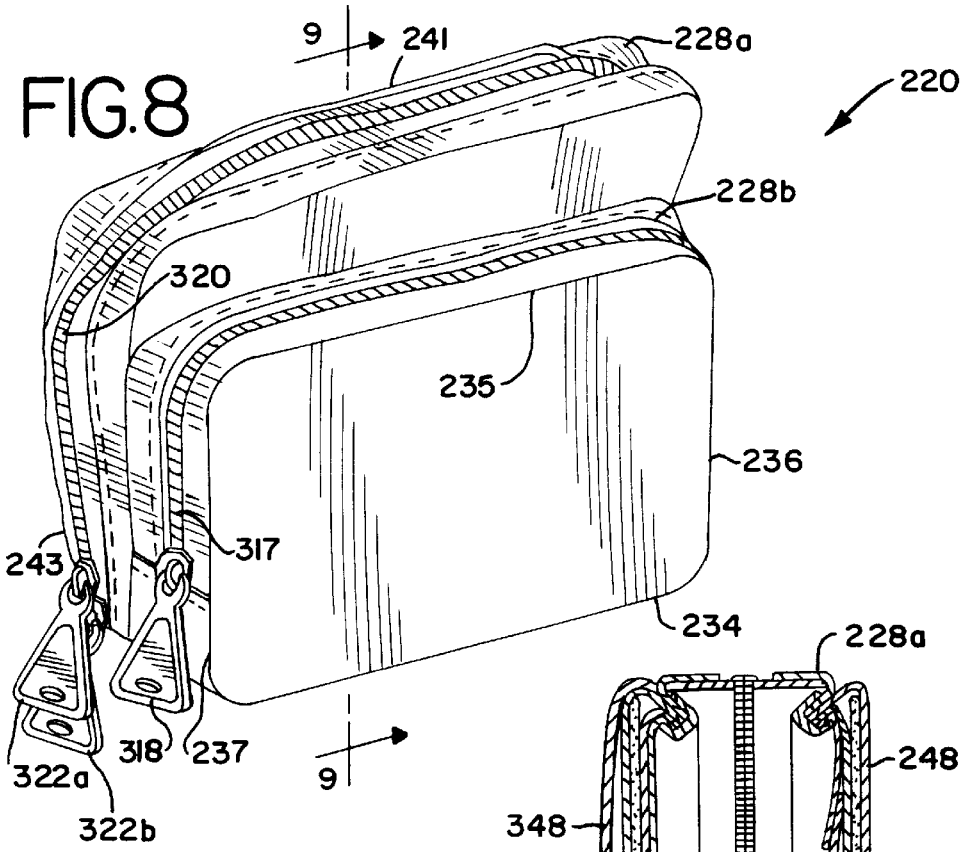
FIG. 8 is a perspective view of the injectable medication carrying case of FIGS. 6 and 7 shown in its fully closed configuration.

Referring now generally to FIGS. 6 through 10, and first more particularly to FIG. 8, an alternative embodiment of the injectable medication carrying case 220 of the present invention is shown. The carrying case 220 includes a top panel 222, a bottom panel 224 opposite the top panel, a side panel 226, an opposing side panel having a raised portion **228*a* and a recessed portion 228*b*, two opposing end panels 230 and 232 and a divider panel 248**.

Cool compartment 246 is defined by the bounded volume of top panel 222 and divider panel 248 (comprising the first dimension of the bounded volume), side panel 226 and recessed side panel **228*b* (comprising the second dimension of the bounded volume), and end panel 230 and end panel 232 (comprising the third dimension of the bounded volume). Conversely, room temperature compartment 272 is defined by the bounded volume of bottom panel 224 and divider panel 248 (comprising a first dimension of the bounded volume), side panel 226 and raised side panel 228*a* (comprising a second dimension of the bounded volume), and end panel 230 and end panel 232 (comprising a third dimension of the bounded volume). Thus, it is to be appreciated that in the alternative embodiment shown in FIGS. 6 through 10, room temperature compartment 272 has a greater volume space than cool compartment 246**. This feature allows the patient to selectively store a greater number of injectable medication supplies within the room temperature compartment than within the cool compartment.

In the embodiment shown in FIG. 8, top panel 222 and side panel 226 are preferably joined at edge 234 of carrying case 220. Top panel 222 is also selectively and releasably secured with recessed side panel **228*b* and with end panels 230 and 232 at edges 235, 236 and 237 of carrying case 220. A releasable attachment assembly, which is shown in this embodiment as a zipper 317 having a pull 318, provides this selective and releasable attachment of top panel 222 with panels 228*b*, 230 and 232. Zipper 317** may be conventional in design and operation as is well known in the art.

Bottom panel 224 and side panel 226 are preferably joined at edge 240 of carrying case 220. In the embodiment shown in FIGS. 6 through 10, bottom panel 224 is selectively and releasably secured with raised side panel 228*a* and with end panels 230 and 232 at edges 241, 242 and 243 of carrying case 220. A releasable attachment assembly, which is shown as double pull zipper 320 having pulls 322*a* and 332*b*, provides this selective and releasable attachment of bottom panel 224 with panels 228*a*, 230 and 232. Double pull zipper 320 may be conventional in design and operation as is well known in the art. Other suitable attachment assemblies could be used.

Referring now particularly to FIG. 7, carrying case 220 is shown in one of its open configurations wherein the medical supplies temporarily stored within the cool compartment 246 are readily visible and accessible to the patient. To partially open the carrying case so that the supplies stored within cool compartment 246 are accessible to the patient, it is necessary to merely unzip (or otherwise manipulate) the attachment assembly, shown as zipper 318, so that top panel 222 is released from recessed side panel 228*b* and from end panels 230 and 232. Top panel 222 is then turned over at edge 234 to expose its underside 247 and the contents stored within cool compartment 246 to the patient.

A portion 248*b* of divider panel 248 is made visible to the patient when the carrying case 220 is in its open configuration shown in FIG. 7. The portion 248*b* of divider panel 248 shown in FIG. 7 includes an elastic strip 324. Elastic strip 324 is sewn or otherwise secured to the portion 248*b* of the divider panel at predetermined locations, forming retaining chambers for supplies selectively stored within cool compartment 246 of carrying case 220. For instance, the elastic strip may retain insulin containers which are desirably stored at a temperature level which is cooler than standard room temperature.

When carrying case 220 is in its open configuration depicted in FIG. 7, the underside 247 of top panel 222 is also readily visible by the patient. Refreezable ice pack storage compartment 258 is attached to underside 247. Compartment 258 is preferably comprised of facing strip 260, back liner 262 and pouch layer 264. Facing strip 260, which is preferably made from a polymer sheeting, extends substantially along the outer perimeter of underside 247 of top panel 222. Back liner 262 is sewn or otherwise secured to facing strip 260 and is contained within the area outlined by the facing strip. Pouch layer 264 is sewn or otherwise secured along the edge 265 of facing strip 260, edge 265 being adjacent to edge 234 of carrying case 220. Furthermore, pouch layer 264 is sewn along substantial portions of opposing edges 266 and 267 of the rectilinear-shaped facing strip 60, leaving a pocket 268 for housing cooling elements 401 such as the refreezable ice packs which are generally known in the art. The cooling elements selectively stored within compartment 258 keep the temperature within cool side 246 at a lower level than ordinary room temperature.

It is to be appreciated that divider panel 248 insulates cool compartment 246 from room temperature compartment 272. Therefore, injectable medication supplies which are meant to be kept at a temperature level cooler than standard room temperature level may be stored within cool compartment 246. Those supplies-which are meant to be kept at standard room temperature level may be stored within room temperature compartment 272.

It is further to be appreciated that the layers of thermally-insulating material within divider panel 248 must only extend over the area defined by portion 248*b*. Under these circumstances, the divider panel 248 is still capable of effectively performing its function of partitioning carrying case 220 into two distinct thermally insulated compartments.

Referring now particularly to FIG. 6, carrying case 220 is shown in another one of its open configurations wherein the injectable medication supplies selectively stored within the room temperature compartment 272 of the carrying case are readily visible and accessible to the patient. To partially open the carrying case so that the supplies selectively stored within room temperature compartment 272 are displayed to the patient, it is necessary to merely unzip (or otherwise manipulate) the attachment assembly, shown as double pull zipper 320 having pulls 322*a* and 322*b*, so that bottom panel 224 is released from raised side panel 228*a* and from end panels 230 and 232. Bottom panel 224 is then turned over at edge 240 to expose its underside 270 and the contents stored within room temperature side 272 to the patient. In the open configuration of the case shown in FIG. 6, the back surface of divider panel 248 is also readily visible by the patient.

A waste pouch 326 is preferably formed along underside 270 of bottom panel 224. Waste pouch 326 preferably comprises a facing strip 328, a liner (not shown), a plastic strip 330 and a releasable attachment assembly, shown as a zipper 332.

Facing strip 328, which is preferably made from a polymer sheeting, extends substantially along the outer perimeter of underside 270 and bottom panel 224. A liner (not shown), which is also preferably made from a polymer sheeting, can be sewn or otherwise secured to facing strip 328 and contained within the area outlined by the facing strip. Likewise, the plastic strip 330 is sewn or otherwise secured to facing strip 328 and is contained within the area outlined by the facing strip. The releasable attachment assembly, shown as zipper 332, facilitates access to waste pouch 326. Similar to removable waste pouch 110 of FIGS. 1–5, waste pouch 326 provides a safe temporary storage space for the medical wastes of the patient until their proper disposal. For example, the patient should store used syringe needles within the waste pouch until such needles can be properly disposed.

A variety of storage compartments are preferably placed along the inside surface of divider panel 248 shown in FIG. 6. The surface of divider panel 248 shown in FIG. 6 preferably comprises a facing strip 334, an inside liner (not shown), an outside liner 338, a releasable attachment assembly (shown as zipper 340), a pouch liner 342 and an elastic strip 344.

Facing strip 334, which is preferably made from a polymer sheeting, extends substantially along the outer perimeter of the surface of divider panel 248 shown in FIG. 6. An inside liner (not shown) can be attached along the edges of facing strip 334 and contained within the area outlined by the facing strip. Likewise, outside liner 338 is also attached along the edges of facing strip 334 and is contained within the area outlined by the facing strip. A releasable attachment assembly, such as the shown zipper 340, facilitates access to and from a storage compartment defined by the bounded volume of facing strip 334, the inside liner (not shown), and outside liner 338. The patient may selectively store his injectable medication supplies within that compartment. For instance, the patient may selectively store electronic meters and other supplies that are desirably kept at standard room temperature.

Pouch liner 342 is sewn along edges of facing strip 334 and with outside liner 338. One edge of pouch liner 342 is preferably not attached to any portion of outside liner 338, thereby defining a mouth portion for an additional storage compartment. Another storage compartment 351 is shown along the side panel 226. Compartment 351 has an access mouth 352 and is well suited for storing thermometers, writing utensils and related elongated items.

Elastic strip 344 is preferably sewn or otherwise secured to outside liner 338 along facing strip 334 and to outside liner 338 adjacent to pouch liner 342. Elastic strip 344 forms an additional retaining chamber for the injectable medication supplies of the patient. With the embodiment shown in FIG. 6, the patient is able to selectively store injectable medication supplies within room temperature side 272 of carrying case 220.

Figure 9:
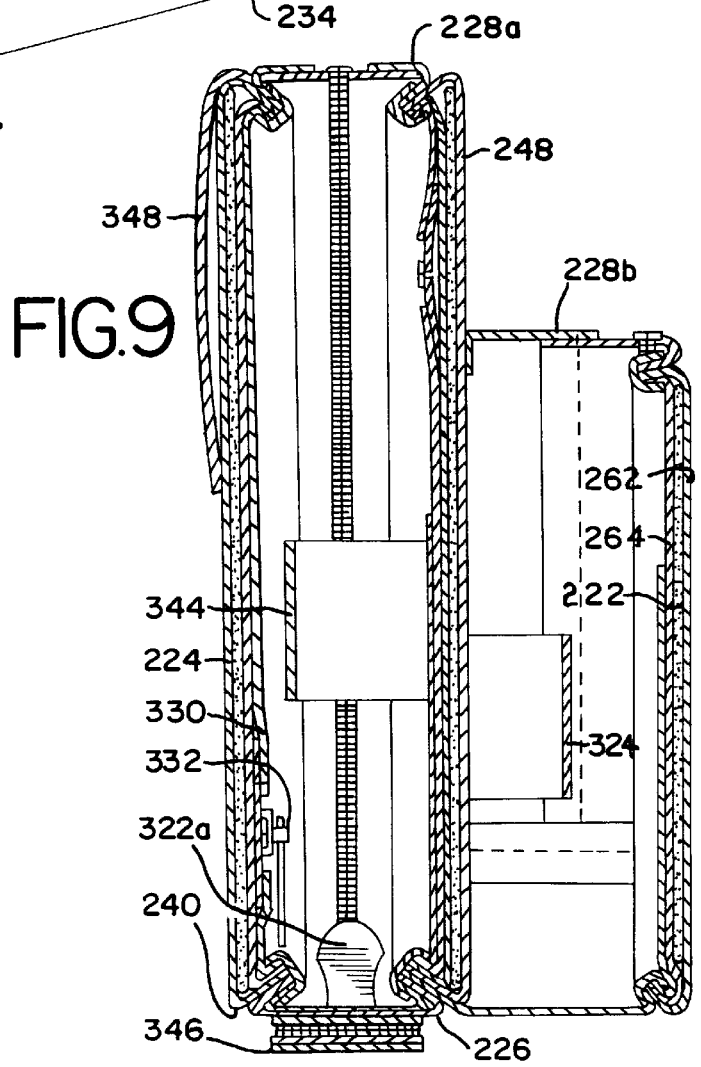
FIG. 9 is a cross-sectional view of the injectable medication carrying case taken along line 9—9 of FIG. 8.
Figure 10:
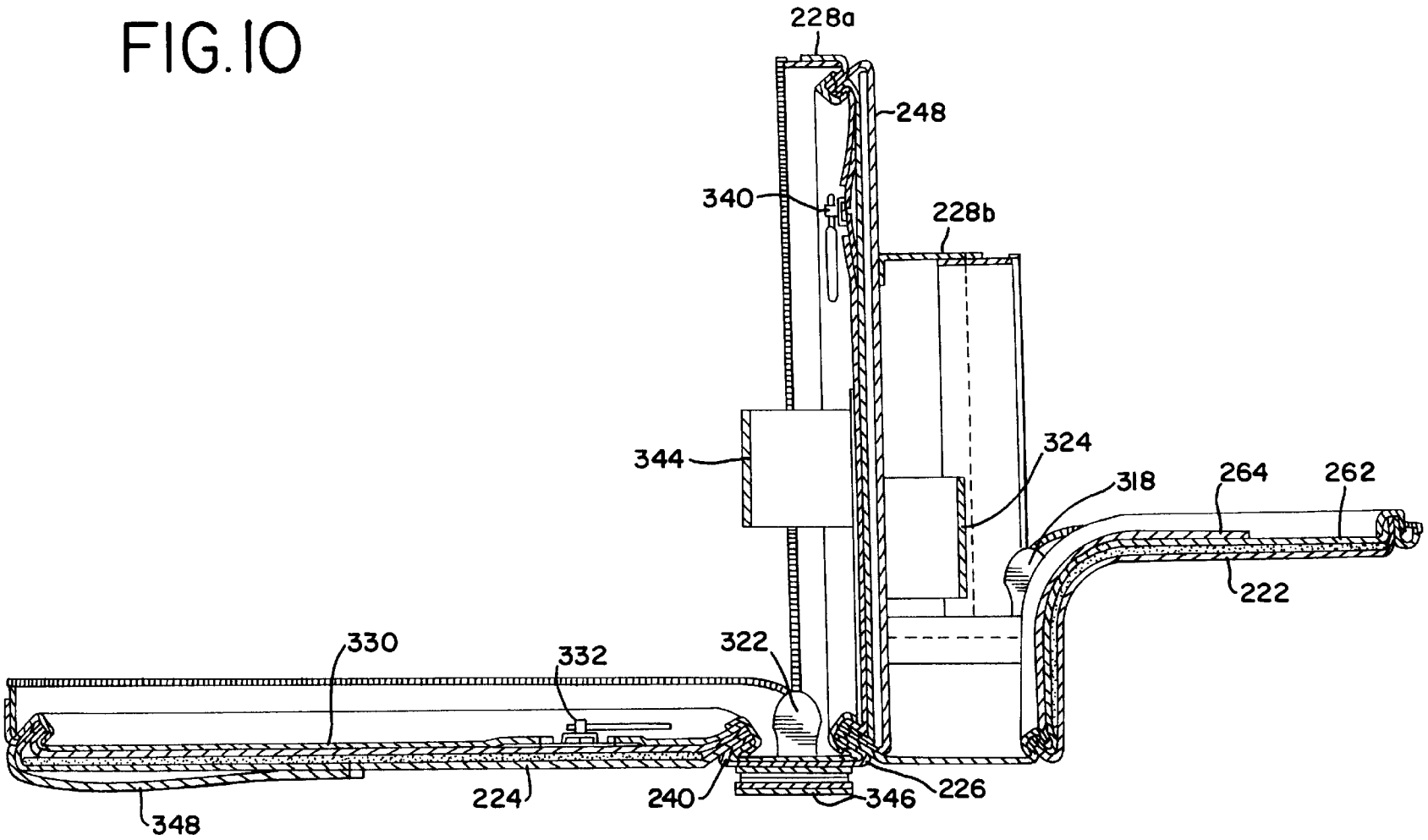
FIG. 10 is a cross-sectional view generally the same as that shown in FIG. 9 but with the top and bottom panels of the injectable medication case detached and spaced apart from the thermally-insulating divider panel.
Figure 6:
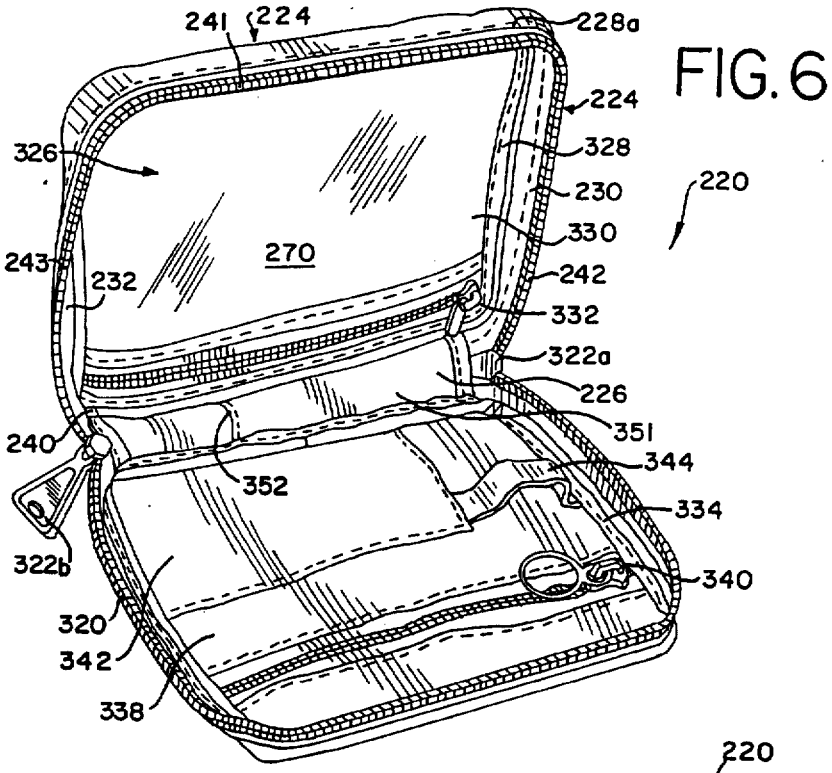
Figure 7:
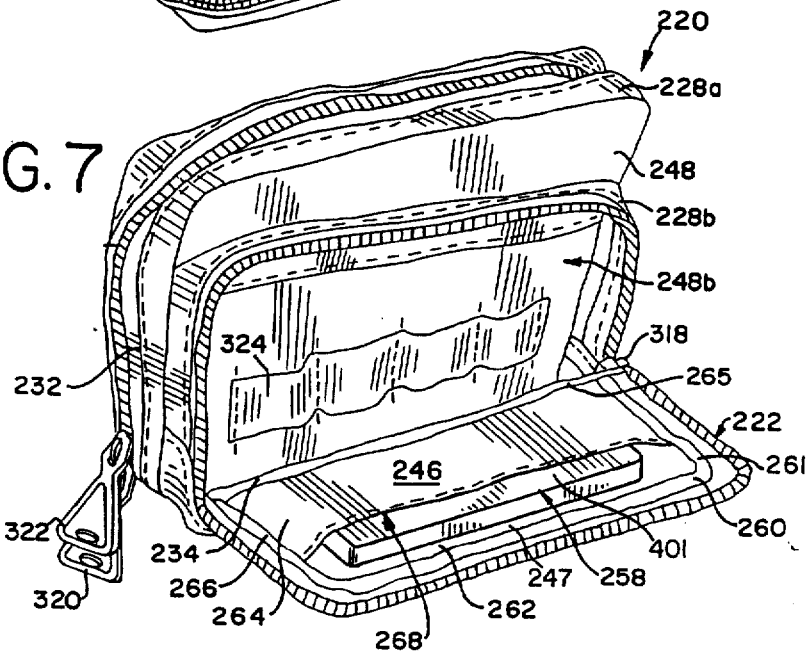

Focusing now on FIGS. 9 and 10, a handle 346 and a rectilinear-shaped retaining component 348 are shown. It is to be appreciated that both handle 346 and retaining component 348 allow the patient to hold case 220 and thereby transport the contents stored within that case from one specified location to another. In particular, handle 346 is comprised of a fabric strip, the ends of which are both preferably sewn to one edge of carrying case 220. In this embodiment, handle 346 resembles a generally circular arrangement. The handle, however, may preferably be placed in a laid down position wherein it extends substantially along side panel 226 of carrying case 220. FIGS. 9 and 10 particularly show the handle in this described position. As shown, a hook-and-loop fastener, such as a VELCRO brand fastener, preferably retains handle 346 in this position.

Retaining component 348 creates an additional means for holding case 220 while transporting the case from one location to another. In its preferred form, two opposing edges of rectilinear-shaped retaining component 348 are sewn or otherwise secured to the exterior surface of the bottom panel. The remaining two opposing edges are somewhat spaced apart and removed from the exterior surface of the bottom panel. It is to be appreciated that this arrangement provides an alternative way to carry case 220 from one location to another. For instance, in one preferred manner, the patient may loop a clothing accessory belt through the two opposing edges of retaining component 348 that are spaced apart and removed from the exterior surface of bottom panel 224. Doing so allows the patient to conveniently and securely transport carrying case 220 from one place to another in a hands-free manner.

The structural elements of injectable medication carrying case 220, particularly the thermally-insulating divider panel 248, partition the case into two temperature level-distinguishing compartments. These elements allow the patient to selectively store injectable medication supplies in a unitary carrying case, as opposed to a plurality of carrying cases.

Further, these elements ensure the effective display of the injectable medication supplies stored within the case when that case is in one of its open configurations. While in one of its open configurations, the carrying case exposes the injectable medication supplies selectively stored within its room temperature compartment or its cool compartment, respectively. This arrangement makes the supplies readily visible and conveniently accessible to the patient.

Although the present invention has been described with reference to certain preferred embodiments, it will be apparent to those skilled in the art that changes and modifications may be made therein without departing from the invention in its broader aspects and, therefore, the aim in the appended claims is to cover all such changes and modifications as fall within the true spirit and scope of the invention.

I claim:

1. A case for carrying injectable medication supplies comprising:

a top panel;

a bottom panel;

a first side panel;

a second side panel opposing said first side panel;

a first end panel;

a second end panel opposing said first end panel;

a thermally-insulating divider panel, the divider panel partitioning said case into at least two distinct compartments;

a top releasable attachment assembly which selectively secures said top panel with each of said second side panel, said first end panel and said second end panel, the top releasable attachment assembly providing selective access to one of said at least two distinct compartments without providing access to another of said at least two distinct compartments;

a bottom releasable attachment assembly which selectively secures the bottom panel with each of said second side panel, said first end panel and said second end panel, the bottom releasable attachment assembly providing selective access to said another distinct compartment without providing access to said one distinct compartment;

said one distinct compartment being separate and independent of said another-distinct compartment; and a cooling element retained in said one distinct compartment, said distinct compartments, said releasable attachment assemblies for the distinct compartments, said thermally-insulating divider panel, and said cooling element cooperate to provide access to said another distinct compartment without dissipating cooling provided by said cooling element within said one compartment.

2. The case as defined in claim 1 wherein said top panel is nonreleasably joined with the first side panel to form an edge of said case therebetween.

3. The case as defined in claim 2 wherein the top releasable attachment assembly generally lies along another edge of said case, said another edge being defined between said top panel and each of said second side panel and said first and second end panels.

4. The case as defined in claim 1 wherein said bottom panel is nonreleasably joined with the first side panel to form an edge of said case therebetween.

5. The case as defined in claim 4 wherein the bottom releasable attachment assembly generally lies along another edge of said case, said another edge being defined between the bottom panel and each of said second side panel and said first and second end panels.

6. The case as defined in claim 1 further comprising an injectable medication storage compartment on an underside of said top panel, said injectable medication storage compartment being capable of storing injectable medication supplies.

7. The case as defined in claim 1 further comprising an injectable medication storage compartment on an underside of said bottom panel, said injectable medication storage compartment being capable of storing injectable medication supplies.

8. The case as defined in claim 1 further comprising an injectable medication storage compartment on a first surface of said divider panel, said first surface of said divider panel opposing an underside of said top panel when said case is in a closed configuration.

9. The case as defined in claim 8 further comprising an injectable medication storage compartment on a second surface of said divider panel, said second surface of said divider panel opposing an underside of said bottom panel when said case is in said closed configuration.

10. The case as defined in claim 1 further comprising an injectable medication storage compartment on a surface of said divider panel, said surface of said divider panel opposing an underside of said bottom panel when said case is in a closed configuration.

11. The case as defined in claim 1 wherein said one distinct compartment is defined by said top panel and said divider panel, said first side panel and said second side panel, and said first end panel and said second end panel as first, second and third dimensions, respectively, of said one distinct compartment.

12. The case as defined in claim 11 wherein said another distinct compartment is defined by said bottom panel and said divider panel, said first side panel and said second side panel, and said first end panel and said second end panel as first, second and third dimensions, respectively, of said another distinct compartment.

13. The case as defined in claim 1 wherein said second side panel comprises a raised side panel and a recessed side panel.

14. The case as defined in claim 13 wherein said one distinct compartment is defined by said top panel and a portion of said divider panel, said first side panel and said recessed side panel, said first end panel and said second end panel as first, second and third dimensions, respectively, of said one distinct compartment.

15. The case as defined in claim 14 wherein said another distinct compartment is defined by said bottom panel and said divider panel, said first side panel and said raised side panel, and said first end panel and said second end panel as first, second and third dimensions, respectively, of said another distinct compartment.

16. The case as defined in claim 1 further comprising a waste pouch, the waste pouch being adjacent to at least one of said panels of said case.

17. The case as defined in claim 16 wherein said waste pouch is removably secured adjacent to at least one of said panels of said case.

18. The case as defined in claim 1 further comprising a handle member secured to a side panel.

19. The case as defined in claim 18 wherein ends of said handle member are secured to an edge of said case so that said handle member is capable of forming a generally circular arrangement, said handle member further being capable of resting in a laid down arrangement along at least one of said panels of said case.

20. The case as defined in claim 1 further comprising an elastic strip on a surface of said thermally-insulating divider panel.

21. The case as defined in claim 20 further comprising a plastic strip on said surface of said thermally-insulating divider panel.

22. The case as defined in claim 21 wherein said elastic strip and said plastic strip are arranged to be capable of cooperatively retaining injectable medication supplies.

23. An injectable medication carrying case comprising:

a top panel;

a bottom panel opposing said top panel;

a first side panel;

a second side panel opposing said first side panel;

a first end panel;

a second end panel opposing said first end panel;

a thermally-insulating divider panel partitioning said case into a room temperature compartment and a cool compartment;

a top releasable attachment assembly which selectively secures the top panel with each of said second side panel, said first end panel and said second end panel, the top releasable attachment assembly providing selective access to said cool compartment without providing access to said room temperature compartment;

a bottom releasable attachment assembly which selectively secures the bottom panel with each of said second side panel, said first end panel and said second end panel, the bottom releasable attachment assembly providing selective access to said room temperature compartment without providing access to said cool compartment; and a cooling element sized and shaped to fit within a pocket, said pocket being within said cool compartment, and said cool compartment being at a temperature lower than that of said room temperature compartment.

24. The case as defined in claim 23 wherein said top panel is nonreleasably joined with the first side panel to form an edge of said case therebetween.

25. The case as defined in claim 24 wherein the top releasable attachment assembly generally lies along another edge of said case, said another edge being defined between said top panel and each of said second side panel and said first and second end panels.

26. The case as defined in claim 23 wherein said bottom panel is nonreleasably joined with the first side panel to form an edge of said case therebetween.

27. The case as defined in claim 26 wherein the bottom releasable attachment assembly generally lies along another edge of said case, said another edge being defined between the bottom panel and each of said second side panel and said first and second end panels.

28. The case as defined in claim 23 further comprising an injectable medication storage compartment on an underside of said top panel, said injectable medication storage compartment being capable of storing injectable medication supplies.

29. The case as defined in claim 23 further comprising an injectable medication storage compartment on an underside of said bottom panel, said injectable medication storage compartment being capable of storing injectable medication supplies.

30. The case as defined in claim 23 further comprising an injectable medication storage compartment on a first surface of said divider panel, said first surface of said divider panel opposing an underside of said top panel when said case is in a closed configuration.

31. The case as defined in claim 30 further comprising an injectable medication storage compartment on a second surface of said divider panel, said second surface of said divider panel opposing an underside of said bottom panel when said case is in said closed configuration.

32. The case as defined in claim 23 further comprising an injectable medication storage compartment on a surface of said divider panel, said surface of said divider panel opposing an underside of said bottom panel when said case is in a closed configuration.

33. The case as defined in claim 23 wherein said cool compartment is defined by said top panel and said divider panel, said first side panel and said second side panel, and said first end panel and said second end panel as first, second and third dimensions, respectively, of said cool compartment.

34. The case as defined in claim 33 wherein said room temperature compartment is defined by said bottom panel and said divider panel, said first side panel and said second side panel, and said first end panel and said second end panel as first, second and third dimensions, respectively, of said room temperature compartment.

35. The case as defined in claim 23 wherein said second side panel comprises a raised side panel and a recessed side panel.

36. The case as defined in claim 35 wherein said cool compartment is defined by said top panel and a portion of said divider panel, said first side panel and said recessed side panel, and said first end panel and said second end panel as first, second and third dimensions, respectively, of said cool compartment.

37. The case as defined in claim 36 wherein said room temperature compartment is defined by said bottom panel and said divider panel, said first side panel and said raised side panel, and said first end panel and said second end panel as first, second and third dimensions, respectively, of said room temperature compartment.

38. The case as defined in claim 23 further comprising a waste pouch, the waste pouch being adjacent to at least one of said panels of said case.

39. The case as defined in claim 38 wherein said waste pouch is removably secured adjacent to at least one of said panels of said case.

40. The case as defined in claim 23 further comprising a handle member secured to a side panel.

41. The case as defined in claim 40 wherein ends of said handle member are secured to an edge of said case so that said handle member is capable of forming a generally circular arrangement, said handle member further being capable of resting in a laid down arrangement along at least one of said panels of said case.

42. The case as defined in claim 23 further comprising an elastic strip on a surface of said thermally-insulating divider panel.

43. The case as defined in claim 42 further comprising a plastic strip on said surface of said thermally-insulating divider panel.

44. The case as defined in claim 43 wherein said elastic strip and said plastic strip are arranged to be capable of cooperatively retaining injectable medication supplies.

* * * * *

UNITED STATES PATENT AND TRADEMARK OFFICE

CERTIFICATE OF CORRECTION

PATENT NO. : 5,865,314

DATED : February 2, 1999

INVENTOR(S) : Jeffrey M. Jacober

It is certified that error appears in the above-identified patent and that said Letters Patent is hereby corrected as shown below:

On the Cover Page, under "References Cited, U.S. Patent Documents", Pat. No. 4,917,238, "Schomaker" should read --Schumacher--.

In the Drawings, Fig. 7, the cooling element should be included and labeled with --401--. (See Drawing.)

Col. 3, line 36, "panels and 32" should read --panels 30 and 32--.

Col. 7, line 8, delete "332b" and insert --322b--; line 62, "supplies-which" should read --supplies which--.

Col. 10, line 30, "another-distinct" should read --another distinct--.

Signed and Sealed this

Thirty-first Day of October, 2000

*Attest:*

*Attesting Officer*

Q. TODD DICKINSON

*Director of Patents and Trademarks*

United States Patent [19]

Jacober

[11] Patent Number: 5,865,314

[45] Date of Patent: Feb. 2, 1999

[54] CASE FOR INJECTABLE MEDICATION WITH COOLING COMPARTMENT

[75] Inventor: Jeffrey M. Jacober, Providence, R.I.

[73] Assignee: MEDport, Inc., Providence, R.I.

[21] Appl. No.: 667,427

[22] Filed: Jun. 21, 1996

[51] Int. Cl.[6] ..... F25D 3/08; A45C 11/20; B65D 69/00

[52] U.S. Cl. ..... 206/570; 62/457.1; 62/457.2; 150/117; 206/570

[58] Field of Search ..... 206/570, 571; 150/112, 113, 116, 117; 190/901; 62/457.2, 457.1, 457.9, 372

[56] References Cited

U.S. PATENT DOCUMENTS

| | | | |
|---|---|---|---|
| D. 284,715 | 7/1986 | Jacober et al. . | |
| D. 299,406 | 1/1989 | Jacober . | |
| D. 322,358 | 12/1991 | Jacober et al. . | |
| 1,790,497 | 1/1931 | Brady | 150/117 X |
| 2,022,162 | 11/1935 | Speik et al. | 150/117 X |
| 2,554,215 | 5/1951 | Schell et al. | 190/901 X |
| 2,623,566 | 12/1952 | Kibler | 190/901 X |
| 2,648,366 | 8/1953 | Higbee et al. | 206/570 |
| 2,804,969 | 9/1957 | Barnett | 206/570 X |
| 3,743,130 | 7/1973 | Jorgensen | 62/457.1 X |
| 4,024,731 | 5/1977 | Branscum . | |
| 4,050,264 | 9/1977 | Tanaka . | |
| 4,065,336 | 12/1977 | Conklin . | |
| 4,213,310 | 7/1980 | Buss . | |
| 4,319,629 | 3/1982 | Hotta . | |
| 4,336,883 | 6/1982 | Krug et al. . | |
| 4,343,158 | 8/1982 | Campbell | 62/457.1 X |
| 4,351,385 | 9/1982 | Amey . | |
| 4,429,793 | 2/1984 | Ehmann | 206/570 |
| 4,461,332 | 7/1984 | Parkhurst | 150/112 |
| 4,499,998 | 2/1985 | Carlson . | |
| 4,706,856 | 11/1987 | Jacober . | |
| 4,767,039 | 8/1988 | Jacober . | |
| 4,917,238 | 4/1990 | Schomaker | 206/570 X |
| 4,940,173 | 7/1990 | Jacober . | |
| 4,984,662 | 1/1991 | Jacober . | |
| 5,007,250 | 4/1991 | Musrelak | 62/457.1 X |
| 5,040,678 | 8/1991 | Lenmark, Sr. et al. . | |
| 5,090,526 | 2/1992 | Jacober . | |
| 5,109,961 | 5/1992 | Bergman | 150/117 X |
| 5,181,612 | 1/1993 | Liu . | |
| 5,361,603 | 11/1994 | Merritt-Munson | 62/457.2 |
| 5,400,610 | 3/1995 | Macedo . | |
| 5,533,361 | 7/1996 | Halpern | 62/457.2 |

*Primary Examiner*—Bryon P. Gehman
*Attorney, Agent, or Firm*—Lockwood, Alex, FitzGibbon & Cummings

[57] ABSTRACT

An injectable medication carrying case is disclosed which includes a top panel, a bottom panel opposing the top panel, two opposing side panels, two opposing end panels, and a thermally-insulating divider panel. The top panel, bottom panel, side panels and end panels can be joined together in standard fashion at respective edges of the carrying case. The divider panel partitions the body portion of the case into two distinct thermally-insulated sides. In this arrangement, the patient is able to selectively store his injectable medication supplies in a unitary carrying case, as opposed to a plurality of carrying cases.

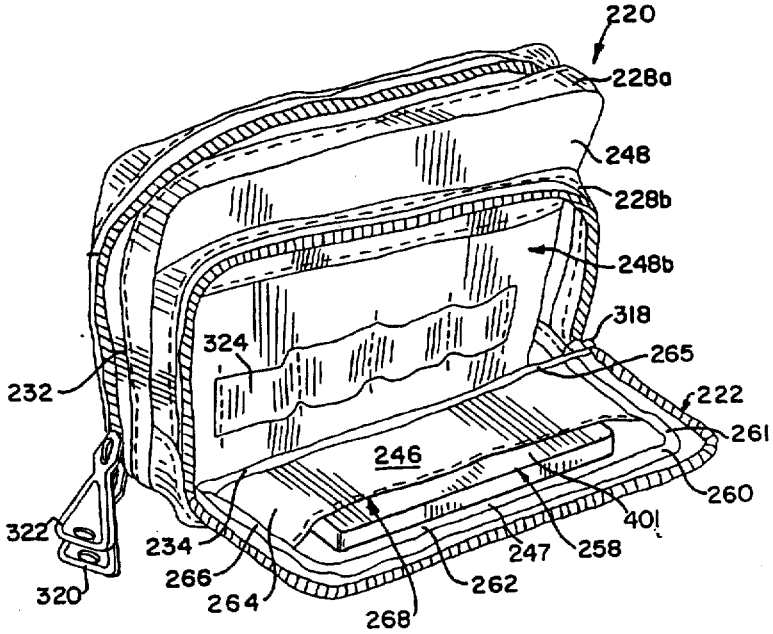

44 Claims, 7 Drawing Sheets